US005372705A

United States Patent [19]

Bhattacharya et al.

[11] Patent Number: 5,372,705

[45] Date of Patent: Dec. 13, 1994

[54] HYDROPROCESSING OF HEAVY HYDROCARBONACEOUS FEEDS

[75] Inventors: Ajit K. Bhattacharya, Hopewell Junction; Jeffrey B. Harrison, Fishkill; Raymond J. Malouf, Hyde Park; Mahendra S. Patel, Hopewell Junction, all of N.Y.

[73] Assignee: Texaco Inc., White Plains, N.Y.

[21] Appl. No.: 973,205

[22] Filed: Nov. 6, 1992

Related U.S. Application Data

[63] Continuation-in-part of Ser. No. 844,092, Mar. 2, 1992, abandoned.

[51] Int. Cl.[5] ..... C10G 47/02

[52] U.S. Cl. ..... 208/112; 208/108; 208/216 R; 208/217; 208/251 H; 208/254 H

[58] Field of Search ..... 208/108, 112, 216 R, 208/217, 251 H, 254 H, 420, 421

[56] References Cited

U.S. PATENT DOCUMENTS

| | | | |
|---|---|---|---|
| 3,956,105 | 5/1976 | Conway | 208/112 |
| 4,134,825 | 1/1979 | Bearden, Jr. et al. | 208/108 |
| 4,578,179 | 3/1986 | Kukes et al. | 208/110 |
| 4,585,751 | 4/1986 | Kukes et al. | 502/211 |
| 5,108,581 | 4/1992 | Aldridge et al. | 208/108 |

*Primary Examiner*—Helen M. S. Sneed
*Assistant Examiner*—Walter D. Griffin
*Attorney, Agent, or Firm*—Dominick G. Vicari

[57] ABSTRACT

A method of catalytically hydroconverting a hydrocarbon feed stream containing a substantial quantity of components boiling above about 1000° F. to convert a substantial portion thereof to components boiling below 1000° F. is disclosed. More particularly, aromatic heavy oil additive, such as Heavy Cycle Gas Oil, is added to a heavy hydrocarbon feed stream and the stream is contacted with a solid catalyst and an oil-miscible metal naphthenate. The method disclosed herein advantageously substantially eliminates plugging of the hydroconversion reactor and minimizes the amount of insolubles in the total liquid product.

20 Claims, No Drawings

HYDROPROCESSING OF HEAVY HYDROCARBONACEOUS FEEDS

CROSS-REFERENCE TO RELATED APPLICATION

This application is a continuation-in-part of U.S. Pat. application Ser. No. 07/844,092, filed Mar. 2, 1992, now abandoned.

BACKGROUND OF THE INVENTION

1. Field of the Invention

The present invention relates generally to the hydroprocessing of heavy hydrocarbon-containing feed streams. More particularly, the present invention relates to a method of converting unwanted components in the heavy feed, primarily to more valuable products, and partly to forms in which they can be easily removed, while, at the same time, substantially eliminating the plugging of the hydroprocessing reactors.

2. Description of Background Art

It is well known by those skilled in the art that during the hydroprocessing (e.g., hydrofining) of heavy hydrocarbon feed streams, the reactors used to process the streams can become plugged. Reactor plugging is undesirable since, among other things, it results in poor operability, impedes adequate conversion, and ultimately leads to unproductive reactor shutdown time.

Reactor plugging is typically ascribed to high concentrations of oil soluble decomposable hydrofining catalytic elements which, by way of illustration, can include Fe, Co or Mo present as naphthenates or other species. In this regard, by way of illustration, U.S. Pat. No. 4,724,069 discloses, in column 5, lines 1–3, that high concentrations, i.e., about 100 ppm and above, of the aforementioned elements should be avoided to prevent plugging of the reactor.

It has also been discovered that the heavy hydrocarbon feed inlet and/or product outlet of continuous flow reactor units are readily plugged during high conversion operations (e.g., 60 or more weight percent) at temperatures of about 780° F. to about 800° F., where a dual catalyst system including 96 wppm or more of molybdenum naphthenate and a solid nickel-molybdenum catalyst component supported on alumina was used. It is believed, in this case, that plugging results from the formation of various insoluble materials. The accumulation of deposits results in severe and/or irreversible plugs and, eventually, the shutdown of the continuous flow reactor unit.

One standard approach of mitigating the problem of reactor plugging utilizes a catalyst system which is devoid of the oil soluble decomposable catalytic elements. This type of catalyst system uses only the solid component, for example, nickel-molybdenum supported on alumina. While this catalyst system affords commercial operability with about 97 wt. % of a mixture of fresh and partially deactivated catalysts of various ages (the mixture henceforth called an equilibrium catalyst), about 3 wt. % of fresh catalyst is usually added to the reactor at regular frequent intervals. This fresh catalyst addition is required to maintain all catalytic activities and to minimize the formation of various undesired insoluble materials. However, it would be desirable to improve the process economics associated with this type of usually expensive fresh catalyst addition. Thus, partial or complete elimination/substitution of fresh catalyst addition—without sacrificing any desired catalytic activities, or compromising insoluble/-sediment control or operability—by some alternative or complementary means would be more favorable.

There are a variety of known techniques for hydroprocessing hydrocarbon-containing feed streams. For instance, U.S. Pat. No. 4,724,069 describes a process for hydrofining a hydrocarbon-containing feed stream in the presence of a supported catalyst bearing a VI-B, VII-B, or VIII metal on alumina, silica, or silica-alumina. A naphthenate of Co or Fe is typically introduced, as an additive, with the charge oil.

U.S. Pat. No. 4,557,823 describes a hydrofining process wherein a hydrocarbon-containing feed stream is contacted with a catalyst composition including a support selected from alumina, silica and silica-alumina, and a promoter including at least one metal selected from Group VI-B, Group VII-B and Group VIII of the Periodic Table. A decomposable compound selected from a Group IV-B metal is introduced into the hydrocarbon-containing feed stream prior to contacting the stream with the catalyst composition.

U.S. Pat. No. 4,389,301 describes hydroprocessing in the presence of an added dispersed hydrogenation catalyst (typically ammonium molybdate) and added porous contact particles (typically FCC catalyst fines, alumina, or naturally occurring clay).

U.S. Pat. No. 4,352,729 describes hydrotreating in the presence of a molybdenum blue solution in polar organic solvent introduced with the hydrocarbon charge.

U.S. Pat. No. 4,298,454 describes the hydroconversion of a coal-oil mixture in the presence of a thermally decomposable compound of a IV-B, V-B, VI-B, VII-B, or VIII metal, preferably Mo.

U.S. Pat. No. 4,134,825 describes the hydroconversion of heavy hydrocarbons in the presence of an oil-soluble compound of IV-B, V-B, VI-B, VII-B, or VIII metal added to the charge, the compound being converted to a solid, non-colloidal form by heating in the presence of hydrogen.

U.S. Pat. No. 4,125,455 describes hydrotreating in the presence of a fatty acid salt of a VI-B metal, typically molybdenum octoate.

U.S. Pat. No. 4,077,867 describes the hydroconversion of coal in the presence of an oil-soluble compound of V-B, VI-B, VII-B, or VIII metal plus a hydrogen donor solvent.

U.S. Pat. No. 4,067,799 describes hydroconversion in the presence of a metal phthalocyanine plus dispersed iron particles.

U.S. Pat. No. 4,066,530 describes hydroconversion in the presence of (i) an iron component, and (ii) a catalytically active metal component prepared by dissolving an oil-soluble metal compound in the oil and converting the metal compound in the oil to the corresponding catalytically active metal component.

Thus, a method of hydrofining a heavy hydrocarbon-containing feed stream which substantially eliminates the plugging of the reactor, while, at the same time, provides favorable conversion, would be a significant contribution to the art.

SUMMARY OF THE INVENTION

Broadly contemplated, the present invention relates to a method of catalytically hydroconverting a hydrocarbon feed stream containing a substantial quantity of components boiling above about 1000° F. to convert a substantial portion thereof to components boiling below 1000° F. which comprises:

(a) adding an aromatic heavy oil additive to said hydrocarbon feed stream;

(b) adding, as an oil-soluble catalyst, a compound of a metal of Group IV-B, V-B, VI-B, VII-B, or VIII to said hydrocarbon feed stream, thereby providing a hydrocarbon, heavy oil and soluble catalyst mixed stream;

(c) passing said hydrocarbon, heavy oil and soluble catalyst mixed stream into contact with a solid heterogeneous catalyst containing a metal of Group IV-B, V-B, VI-B, VII-B, or VIII on a support;

(d) maintaining said hydrocarbon, heavy oil and soluble catalyst mixed stream in contact with said solid heterogeneous catalyst at conversion conditions and in the presence of hydrogen and mercaptan as a substantial portion of said components boiling above about 1000° F. are converted to components boiling below 1000° F. thereby forming a product containing a substantial portion of components boiling below about 1000° F.; and (e) recovering said product containing a substantial portion of components boiling below about 1000° F. optionally, recycling the portion of said product that still contains components boiling above about 1000° F. back into the hydrocarbon feed stream to enhance said conversion.

Advantageously, when the method of this invention is employed to hydroprocess a heavy hydrocarbon-containing feed stream, reactor plugging is substantially eliminated, while favorable conversion is also demonstrated. Other characteristic advantages of the prescribed process include facilitated removal of contaminant metals, such as nickel, vanadium and iron; heteroatoms, such as sulfur, nitrogen and oxygen; and microcarbon residues.

DESCRIPTION OF THE PREFERRED EMBODIMENTS

The feed which may be treated by the process of this invention includes high boiling hydrocarbons; typically those having an initial boiling point (ibp) above about 650° F. This process is particularly useful to treat hydrocarbon feeds containing a substantial quantity of components boiling above about 1000° F. to convert a substantial portion thereof to components boiling below 1000° F.

Typical of these feed streams are heavy crude oils, topped crudes, vacuum resids, asphaltenes, tars, coal liquids, vis-breaker bottoms and the like. The feed stream can include, by way of illustration, a vacuum resid obtained by blending vacuum resid fractions from Alaska North Slope Crude (59 vol. %), Arabian Medium Crude (5 vol. %), Arabian Heavy Crude (27 vol. %), and Bonny Light Crude (9 vol. %) having the characteristics listed below in Column A. Another typical feedstock may be Arab Medium vacuum resid having the properties listed below in Column B.

| Property | Feedstock A | Feedstock B |
|---|---|---|
| API Gravity | 5.8 | 5.2 |
| 1000° F. + (wt. %) | 93.1 | 94.6 |
| Alcor Microcarbon Residue (McR) (%) | 19.86 | 22.80 |
| n-$C_7$ insolubles (%) | 11.97 | 12.37 |

-continued

| Property | Feedstock A | Feedstock B |
|---|---|---|
| Composition (wt. %): | | |
| C | 84.8 | 83.6 |
| H | 10.09 | 10.2 |
| N | 0.52 | 0.43 |
| S | 3.64 | 5.60 |
| Metals content (wt. ppm): | | |
| Ni | 52 | 56 |
| V | 131 | 149 |
| Fe | 9 | 10.3 |
| Cr | 0.7 | 0.1 |
| Na | 5 | 7.5 |
| Al | — | 3.4 |
| Si | — | 0.1 |
| Ca | — | 1.5 |
| Mg | — | 2.1 |

The subject hydrocarbon feeds are characterized by containing certain undesirable components, typically nitrogen (in amounts up to about 1 wt. %, typically about 0.2–0.8 wt. %, say about 0.43 wt. %); sulfur (in amounts up to about 10 wt. %, typically about 2–6 wt. %, say about 5.6 wt. %); and metals including Ni, V, Fe, Cr, Na, etc. (in amounts up to about 900 wt. ppm, typically about 40–400 wt. ppm, say about 230 wt. ppm). The undesirable asphaltene content of the hydrocarbon feed may be as high as about 22 wt. % typically about 8–16 wt. %, say about 12.37 wt. % (analyzed as components insoluble in normal heptane).

The API gravity of the feed may be as low as about minus 5, typically between about minus 5 to about plus 35, say about 5.2. The content of components boiling above about 1000° F. may be as high as about 100 wt. %, typically about 50–98 wt. %, say about 94.6 wt. %. The Alcor Micro Carbon Residue (MCRi content may be as high as about 30 wt. %, typically about 15–25 wt. %, say about 22.8 wt. %.

In the practice of the method of this invention, the charge hydrocarbon feed may be passed to a hydroconversion operation wherein conversion occurs in liquid phase at conversion conditions including about 700° F. to about 850° F., preferably about 750° F. to about 810° F., say about 800° F., at a hydrogen partial pressure of about 500 to about 5000 psig, preferably about 1500 to about 2500 psig, say about 2000 psig.

Pursuant to the method of this invention, an aromatic heavy oil additive is added to the above described hydrocarbon feed stream. The aromatic heavy oil additive can include, for instance, coker oil, cracked oil, light cycle gas oil (LCGO) and heavy cycle gas oil (HCGO). The aromatic heavy oils generally comprise fused aromatic rings attached to paraffinic or naphthenic moieties. They also include five and six membered polycyclic and heterocyclic sulfur, nitrogen and oxygen-containing compounds. The aromatic heavy oils may be characterized by API gravity of about −5 to about 25, preferably about 1; they boil within the range of about 350° to about 995°, preferably about 500° to about 995°; and have an aromatic content of about 25 wt. % to about 90 wt. % preferably about 50 wt. % to about 85 wt. %.

In a preferred embodiment, the aromatic heavy oil that is added to the hydrocarbon feed stream is HCGO which is derived, for example, from the Fluid Catalytic Cracking (FCC) unit. The HCGO may be added in about 5 wt. % to about 25 wt. %, preferably about 13 wt. % of the combined feed streams.

By way of illustration, a preferred HCGO contains about 86.6 wt. % carbon, about 7.19 wt. % hydrogen, about 0.19 wt. % nitrogen, and about 5.42 wt. % sulphur. The metals content, in wppm, is Ni (6.3), V (4.2) and Fe (20.7). The HCGO exhibits boiling within the range of about 645° to about 993° and the content of components boiling below 1000° F. is about 91 wt. %.

It is a feature of the method of this invention that there is added to the hydrocarbon feed (preferably prior to admission to hydroconversion), as an oil-soluble catalyst, a catalytically effective amount of an oil-miscible, preferably an oilsoluble, catalyst compound of a metal of Group IV-B, V-B, VI-B, VII-B, or VIII of the Periodic Table.

Preferred Group IV-B metals are selected from titanium (Ti), zirconium (Zr) or hafnium (Hf). Preferred Group V-B metals are selected from vanadium (V), niobium (Nb), or tantalum (Ta), while preferred Group VI-B metals are selected from chromium (Cr) , molybdenum (Mo) , or tungsten (W), and preferred Group VII-B metals are selected from manganese (Mn) or rhenium (Re). When the metal is a Group VIII metal, it may be a non-noble metal, such as iron (Fe), cobalt (Co), or nickel (Ni) or a noble metal, such as ruthenium (Ru), rhodium (Rh), palladium (Pd), osmium (Os), iridium (Ir), or platinum (Pt). In a most preferred embodiment, the metal is a Group VI-B metal, the most preferable being molybdenum (Mo).

The compound of the aforementioned metals is an oil-soluble compound including: (1) metal salts of aliphatic carboxylic acids, such as molybdenum stearate, molybdenum palmitate, molybdenum myristate, or molybdenum octoate; (ii) metal salts of naphthenic carboxylic acids, such as cobalt naphthenate, iron naphthenate, or molybdenum naphthenate; (iii) metal salts of alicyclic carboxylic acids, such as molybdenum cyclohexane carboxylate; (iv) metal salts of aromatic carboxylic acids, such as cobalt benzoate, cobalt o-methyl benzoate, cobalt m-methyl benzoate, cobalt phthalate, or molybdenum p-methyl benzoate; (v) metal salts of sulfonic acids, such as molybdenum benzene sulfonate, cobalt p-toluene sulfonate, or iron xylene sulfonate; (vi) metal salts of sulfinic acids, such as molybdenum benzene sulfinate or iron benzene sulfinate; (vii) metal salts of phosphoric acids, such as molybdenum phenyl phosphate; (viii) metal salts of mercaptans, such as iron octyl mercaptide or cobalt hexyl mercaptide; (ix) metal salts of phenols, such as cobalt phenolate or iron phenolate; (x) metal salts of polyhydroxy aromatic compounds, such as iron catecholate or molybdenum resorcinate; (xi) organometallic compounds, such as molybdenum hexacarbonyl, iron hexacarbonyl, or cyclopentadienyl molybdenum tricarbonyl; (xii) metal chelates, such as ethylene diamine tetra carboxylic acid-diferous salt; and (xiii) metal salts of organic amines, such as cobalt salt of pyrrole.

The preferred compounds are selected from cobalt naphthenate, nickel 2-ethylhexanoate, molybdenum hexacarbonyl, molybdenum naphthenate, and molybdenum octoate and mixtures thereof.

It is found that the catalytic activity of the oil-soluble compound may be augmented by use of compounds of more than one metal. For example, if molybdenum (e.g., as the naphthenate) is employed, it is found desirable to add an additional quantity of cobalt or nickel (e.g., as the naphthenate). This yields a positive synergistic promotion effect on catalytic desulfurization and demetallization. Typically, cobalt or nickel may be added in amounts of about 0.2–2 moles, say about 0.4 moles per mole of molybdenum.

The metal compounds to be employed are oil-miscible and preferably oil-soluble, i.e., they are soluble in the charge hydrocarbon oil in amounts of at least about 0,001 gram/100 grams, typically about 0.0025–0.25 grams/100 grams, say about 0.1 grams/100 grams or, alternatively, they are readily dispersable in the hydrocarbon feed in at least those prescribed amounts. It is also a feature of these metal compounds that, when activated as hereinafter set forth, the activated compounds are also oil-miscible in the hydrocarbon feeds with which they come into contact during practice of the method of this invention.

Activation of the oil-miscible compound derived from a metal of Group IV-B, V-B, VI-B, VII-B, or VIII in accordance with practice of the process of this invention may be effected either by pre-treatment (prior to hydroconversion) or in situ (during hydroconversion). It is preferred to effect activation in situ in the presence of the hydrogenation catalyst to achieve a highly dispersed catalytic species.

Activation according to the preferred method may be carried out by adding about 10–200 wt. ppm, say about 30 parts of metal compound to the hydrocarbon feed at about 60° F. to about 300° F., say about 200° F. The mixture is activated by heating to about 400° F.–835° F., typically about 500° F.–700° F., say about 600° F. at partial pressure of hydrogen of about 500–5000 psig, typically about 1000–3000 psig, say about 2000 psig and at partial pressure of a gaseous mercaptan of about 5–500 psig, typically about 10–300 psig, say about 50 psig. Total pressure may be about 500–5500 psig, typically about 1000–3300 psig, say about 2050 psig. Commonly, the gas may contain about 40–99 vol. %, typically about 90–99 vol. %, say about 98 vol. % hydrogen and about 1–10 vol. %, say about 2 vol. % mercaptan, such as hydrogen sulfide. Time of activation may be about 1–12 hours, typically about 2–6 hours, say about 3 hours.

In the aforementioned preferred means of activation, it will be noted that activation may occur at a temperature which is lower than the temperature of conversion.

The mercaptans which may be employed may include hydrogen sulfide; aliphatic mercaptans, typified by methyl mercaptan, lauryl mercaptan, etc.; aromatic mercaptans; dimethyl disulfide; and carbon disulfide, etc.

These mercaptans apparently decompose during the activation process. It is not clear why this treatment activates the metal compound. It may be possible that the activity is generated as a result of metal sulfides formed during the treatment.

When the sulfur content of the charge hydrocarbon is above about 2 wt. %, it may not be necessary to add a mercaptan during activation, i.e., hydrodesulfurization of the charge may provide enough mercaptan to properly activate (i.e., sulfide) the oil-miscible decomposable catalyst.

In an alternative activation procedure, the oil-miscible metal compound may be activated in the presence of an oil which is compatible with the hydrocarbon feed, i.e., a separate portion of the feed or a different stream which is compatible with the feed. In this alternative embodiment, the oilmiscible metal compound may be added to the feed in amount which is substantially greater (e.g., 2–20 times) than is the case when the compound is activated in the presence of the feed stream.

After activation (at the same conditions as prevail when activation is carried out in the feed stream), the compatible oil, containing the now activated metal, may be admitted to the feed stream in an amount sufficient to provide therein, the activated oil-miscible metal compound in a desired amount.

In still another embodiment, activation may be carried out by subjecting the hydrocarbon feed containing the oil-miscible metal compound to hydroconversion conditions, including temperatures of about 700° F.–850° F., preferably about 750° F.–810° F., say about 800° F. at hydrogen partial pressure of about 500–5000 psig, preferably about 1500–2000 psig, say about 2000 psig and in the presence of a mercaptan, but in the absence of a heterogeneous hydroconversion catalyst.

In the preferred embodiment, activation may be carried out during hydroconversion, i.e., in the presence of the heterogeneous, hydroconversion catalyst, hydrogen and mercaptan.

Hydroconversion is carried out in the presence of solid heterogeneous catalyst containing, as a hydrogenating component, a metal of Group IV-B, V-B, VI-B, VII-B, or VIII on a support which may typically contain carbon or an oxide of aluminum, silicon, titanium, magnesium, or zirconium or mixtures thereof. Preferably, the catalyst may contain a metal of Group VI-B and VIII; typically nickel and molybdenum.

Preferred Group IV-B metals are selected from titanium (Ti) or zirconium (Zr), while preferred Group V-B metals are selected from vanadium (V), niobium (Nb), or tantalum (Ta), preferred Group VI-B metals are selected from chromium (Cr), molybdenum (Mo), or tungsten (W), preferred Group VII-B metals, are selected from manganese (Mn) or rhenium (Re), and preferred Group VIII metals are selected from non-noble metals, such as iron (Fe), cobalt (Co), or nickel (Ni); or noble metals, such as ruthenium (Ru), rhodium (Rh), palladium (Pd), osmium (Os), iridium (Ir), or platinum (Pt).

The solid heterogeneous catalyst may also contain, as a promoter, a metal of Groups I-A, I-B, II-A, II-B, or V-A.

Preferred Group I-A metals are selected from sodium (Na) or potassium (K), while the preferred Group I-B metal is copper (Cu), preferred Group II-A metals are selected from beryllium (Be), magnesium (Mg), calcium (Ca), strontium (St), barium (Ba), or radium (Ra), preferred Group II-B metals are selected from zinc (Zn), cadmium (Cd), or mercury (Hg), and preferred Group V-A metals are selected from arsenic (As), antimony (Sb), or bismuth (Bi).

The hydrogenating metal may be loaded onto the solid heterogeneous catalyst by immersing the catalyst support in solution (e.g., ammonium heptamolybdate) for about 2–24 hours, say about 24 hours, followed by drying at about 60° F.–300° F., say about 200° F. for about 1–24 hours, say about 8 hours and calcining for about 1–24 hours, say about 3 hours at 750° F. 1100° F., say about 930° F.

The promoter metal is preferably loaded onto the solid heterogeneous catalyst by immersing the catalyst support (preferably bearing the calcined hydrogenating metal, although they may be added simultaneously or in any order) in solution (e.g., bismuth nitrate) for about 2–24 hours, say about 24 hours, followed by drying at about 60° F.–300° F., say about 200° F. for about 1–24 hours, say about 3 hours, and calcining at about 570° F.–1100° F., say about 750° F. for about 1–12 hours, say about 3 hours.

The solid heterogeneous catalyst employed in the method of this invention may be characterized by a Total Pore Volume of 0.2–1.2 cc/g, say 0.77 cc/g; a Surface Area of 50–500 $m^2/g$, say 280 $m^2/g$; and a Pore Size Distribution as follows:

| Pore Diameter (Å) | Volume (cc/g) |
|---|---|
| 30–100 | 0.15–0.8, say 0.42 |
| 100–1000 | 0.10–0.50, say 0.19 |
| 1000–10,000 | 0.01–0.40, say 0.16 |

In another embodiment, it may have a pore size distribution as follows:

| Pore Diameter (Å) | Pore Volume (cc/g) | Typical |
|---|---|---|
| >250 | 0.12–0.35 | 0.28 |
| >500 | 0.11–0.29 | 0.21 |
| >1500 | 0.08–0.26 | 0.19 |
| >4000 | 0.04–0.18 | 0.11 |

The solid heterogeneous catalyst typically may contain about 4–30 wt % say about 9.5 wt % Mo, about 0–6 wt. %, say about 3.1 wt. % Ni and about 0–6 wt. %, say about 3.1 wt. % of promoter metal, e.g., bismuth. The Liquid Hourly Space Velocity (LHSV) in the hydroconversion reactors may be about 0.1–2 $hr^{-1}$ say about 0.3 $hr^{-1}$. Preferably, the heterogeneous catalyst may be employed in the form of extrudates of diameter of about 0.7–6.5 mm, say about 1 mm, and a length of about 0.2–25 mm, say about 5 mm.

Hydroconversion may be carried out in a fixed bed, stirred tank Robinson-Mahoney reactor containing a catalyst basket, a moving bed, a fluidized bed or, preferably, an ebullated bed.

It is a feature of the process of this invention that hydroconversion may be carried out in one or more beds. It is found that the active form of the catalyst is formed in or accumulates in the first of several reactors and, accordingly, increases in conversion and heteroatom removal activities appear to occur in the first of several reactors.

Effluent from hydroconversion is typically characterized by an increase in the content of liquids boiling below about 1000° F. Commonly, the weight percent conversion of the 1000° F. plus boiling material is about 30%–90%, say about 67% which is typically about 5%–25%, say about 12% better than is attained by the prior art techniques. Optionally, the portion of the effluent from hydroconversion, i.e., the product, that still contains components boiling above about 1000° F., although an unsubstantial amount, may be recycled back into the hydrocarbon feed stream to enhance conversion.

It is a feature of this invention that it permits attainment of improved removal of sulfur (HDS Conversion), of nitrogen (HDN Conversion), and of metals (e.g., HDNi and HDV Conversion). Typically, HDS Conversion may be about 30–90%, say about 65% which is about 1%–10%, say about 4% higher than the control runs. Typically, HDN Conversion may be about 20%–60%, say about 45% which is about 1%–10%, say about 4% higher than control runs. Typically, HDNi plus HDV Conversion may be about 70%–99%, say about 90% which is about 5%-20% say about 13% higher than control runs.

The following Examples I-VII are provided to illustrate specific embodiments of the present invention; they should not be construed as limiting-the present invention in any way.

EXAMPLES I-V

In Examples I-V, a feed consisting of 100 percent Arab Medium VR (boiling point 1000° F.+) was charged to a bench scale hydrofining reactor unit to convert a substantial portion of those components boiling above about 1000° F. to a substantial portion of components boiling below 1000° F. As a typical solid heterogeneous fresh catalyst, a commercially available hydrotreating catalyst HDS-1443B (sold by Criterion Catalyst Company) containing about 2.8 wt. % nickel and 8.8 wt. % molybdenum on alumina was employed. As a solid heterogeneous equilibrium catalyst, a typical mixture of fresh and partially deactivated catalysts of various ages (withdrawn from an ebullated bed commercial reactor unit) containing about 3.1 wt. % nickel, 4.4 wt. % molybdenum, 6.6 wt. % vanadium, 9.7 wt. % sulfur, 0.5 wt. % nitrogen, 26.7 wt. % carbon, and 2.0 wt. % hydrogen was employed. In Examples II, IV and V a soluble molybdenum naphthenate catalyst was added to the feed at the concentration levels identified below in Table IA. The solid/soluble catalyst system was activated in situ during the hydrofining of the feed, which occurred at a temperature of 785° F. and a pressure of 2250 psig ($H_2$). The soluble catalyst used in Example V further included 40 ppm (by weight) of soluble nickel 2-ethylhexanoate. The hydroconverted product effluent was analyzed to achieve certain findings associated with each of the processes practiced in Examples I-V; the underlying data is reported in Table IA. The weight percent of insolubles in the total liquid product (TLP) was measured for each run using cyclohexane ($C_6H_{12}$) as a diluent solvent. After each run, the catalyst basket and internals of the reactor unit were scrubbed and flushed with tetrahydrofuran (THF) and the mixture was filtered to remove small amounts of solids, if any. The filtrate was evaporated in vacuo to remove THF. The insolubles (weight percent) in the residual oil, i.e., the recovered deposits, were also measured for each run with cyclohexane. The LHSV for the runs conducted in Examples I-V was 0.36 $hr^{-1}$.

TABLE IA

| Example No. | Solid Catalyst | Soluble Mo ppm (by wt.) | Run Hrs. | Ease of Operation (rank)* | 1000° F. + ΔConv (max) Wt. %/hr. | Wt. % Insolubles (in $C_6H_{12}$) in TLP | Deposits |
|---|---|---|---|---|---|---|---|
| I | Fresh | 0 | 80.5 | 2 | 0.0 | 1.97 | 4.12 |
| II | Fresh | 96 | 75.0 | 4 | 0.13 (6.3 wt. %/48 hr.) | 2.43 | 5.82 |
| III | Equilibrium | 0 | 90.0 | 5 | 0.0 | 4.18 | 10.22 |
| IV | Equilibrium | 96 | 57.5 | 6 | 0.45 (10.9 wt. %/24 hr.) | 6.01 | 12.63 |
| V | Equilibrium | 96** | 60.0 | 7 | 0.47 (4.2 wt. %/9 hr.) | 3.55 | 15.00 |

*See also Examples VI and VII and Table IIA below, which are included in these data representing "Ease of Operation".
**Included an additional 40 wt. ppm of soluble Ni.

Comparison of weight percent insolubles in Example I versus Example III, and Example II versus Example IV, shows that reduced amounts of insolubles are formed with fresh catalyst as opposed to the equilibrium catalyst.

Comparison of insolubles (weight percent) in Example I versus Example II, and Example III versus Example IV shows that addition of soluble molybdenum naphthenate to a typical feedstock such as 100% Arab Medium vacuum resid leads to higher amounts of insolubles formation, regardless of whether fresh of equilibrium catalysts are employed.

As these data further demonstrate, the weight percent of insolubles in the total liquid product (TLP) and/or in the reactor deposits got progressively worse while proceeding through Examples I-V. Also, the ease of operation declined through the runs conducted in Examples I-V. Thus, it is apparent that the higher the amounts of insolubles in the total liquid product and reactor deposits, the worse is the ease of operation. As the insoluble sediments and coke tend to accumulate/deposit onto the solid catalysts, as well as the reactor internals and at the inlet and outlet tubes, the ease of operation decreases and the tendency to develop plugs increases.

The run conducted in Example V, wherein the catalyst employed included an additional 40 wt. ppm of soluble Ni, exhibited a lower concentration of insolubles in the TLP. It is believed that this is ascribed to a beneficial synergistic promotional effect of soluble Ni and soluble Mo on reduction of insolubles in the TLP. However, a higher concentration of insolubles were obtained in the reactor deposits which, in turn, led to inferior operating conditions.

Additional attendant characteristics of the method of the present invention are exemplified by the data presented below in Table IB.

TABLE IB

| Ex. No. | Run Hours | Weight Percent HDS | HDV | HDNi | MCRC | H/C (Atomic Ratio) Feed | Product |
|---|---|---|---|---|---|---|---|
| I | 80.5 | 63 | 76 | 59 | 36 | 1.44 | 1.53 |
| II | 75.0 | 67 | 87 | 69 | 47 | 1.46 | 1.55 |
| III | 90.0 | 49 | 64 | 46 | 34 | 1.44 | 1.48 |
| IV | 57.5 | 66 | 82 | 72 | 22 | 1.45 | 1.53 |
| V | 60.0 | 66 | 90 | 88 | 57 | 1.44 | 1.54 |

EXAMPLES VI AND VII

In Examples VI and VII, a feed consisting of 80 wt. % Arab Medium VR (boiling point 1000° F.+) and 20 wt. % HCGO was charged to the hydrofining reactor unit, as in Examples I-V. The soluble molybdenum naphthenate catalyst was added to the feed at the concentration levels identified in Table IIA. The solid/soluble catalyst system was activated and the hydroconversion occurred in the same manner as set forth in Examples I-V. The LHSV for the runs conducted in Examples VI and VII was 0.28 $hr^{-1}$. Also, the hydroconverted total liquid product effluents and the reactor deposits were analyzed in the same manner as done above in Examples I–V; the results are reported below in Table IIA.

TABLE IIA

| Example No. | Solid Catalyst | Soluble Mo ppm (by wt.) | Run Hrs. | Ease of Operation (rank)* | 1000° F. + ΔConv (max) Wt. %/hr. | Wt. % Insolubles (in $C_6H_{12}$) in TLP | Deposits |
|---|---|---|---|---|---|---|---|
| VI | Equilibrium | 0 | 150.0 | 3 | 0.0 | 5.88 | 4.51 |
| VII | Equilibrium | 96 | 162.0 | 1 | 0.54 (12.9 wt. %/24 hr) | 1.66 | 2.91 |

*See also Table IA above

As discussed earlier, comparison of insolubles in Example I versus Example II, and Example III versus Example IV shows that addition of soluble Mo to Arab Medium vacuum resid (100%) leads to higher amounts of insolubles formation. On the other hand, comparison of insolubles in Example VI versus Example VII shows surprisingly that addition of soluble Mo to a mixture of Arab Medium vacuum resid and HCGO affords a very much lower amount of insolubles formation. The ease of operation for runs conducted in Example VII was also significantly better than all the other runs conducted in Examples I–VI. The unexpected improvements in Example VII are believed to be ascribed to the beneficial synergistic effects of four components; namely, a solid catalyst, a heavy hydrocarbon feedstock, an aromatic heavy oil additive, and an oil-miscible metal naphthenate or related decomposable compounds of one or more metals.

The advantageous results associated with the method of this invention are further demonstrated below in Tables IIB and III which provide the total weight percent material balance of the runs practiced in Examples I–VII (Table III) and the catalytic activities of the catalysts employed in Examples VI–VII (Table IIB), including the catalytic activities for hydrodesulfurization (HDS), hydrodevanadization (HDV), hydrodenickelization (HDNi) and micro carbon residue conversion (MCRC).

Comparison of data for Example I versus Example III, and Example II versus Example IV shows that usually higher catalytic activities are obtained in the presence of the fresh catalyst as opposed to the equilibrium catalyst.

Comparison of data for Example I versus Example II, and Example III versus Example IV shows that addition of soluble molybdenum naphthenate to a typical feedstock usually leads to higher catalytic activities regardless of whether fresh or equilibrium catalysts are employed. The run in Example V which included an additional 40 wt. ppm of soluble Ni, usually exhibited even higher catalytic activities. This is believed to be ascribed to the beneficial synergistic promotional effects of soluble Ni and soluble Mo.

Comparison of data for Example VI versus Example VII shows that addition of soluble Mo to a typical mixture of Arab Medium vacuum resid and HCGO usually affords higher catalytic activities. It should be noted that Example VII represents our most preferred mode of operation involving maintenance of longest plug-free continuous flow operation.

Additional attendant characteristics of the method of the present invention are exemplified by the data presented below in Table IIB.

TABLE IIB

| Ex. No. | Run Hours | Weight Percent HDS | HDV | HDNi | MCRC | H/C (Atomic Ratio) Feed | Product |
|---|---|---|---|---|---|---|---|
| VI | 150.0 | 52 | 76 | 48 | 45 | 1.38 | 1.38 |
| VII | 162.0 | 60 | 69 | 51 | 51 | 1.37 | 1.43 |

TABLE III

Total Weight Percent Material Balance of Examples I–VII

| Example No. | Liquids[1] | S + N − H[2] | Insolubles[3] | Total |
|---|---|---|---|---|
| I | 94.7 | 3.1 | 1.9 | 99.7 |
| II | 88.4 | 2.9 | 2.2 | 93.5 |
| III | 92.0 | 2.2 | 4.0 | 98.2 |
| IV | 90.2 | 2.3 | 5.8 | 98.3 |
| V | 90.6 | 2.1 | 3.3 | 96.0 |
| VI | 89.6 | 2.8 | 5.6 | 98.0 |
| VII | 90.5 | 2.7 | 1.5 | 94.7 |

[1]Liquids = weight percent total liquid product over feed
[2]S + N − H = weight percent [(sulfur in feed − sulfur in total liquid product) + (nitrogen in feed − nitrogen in total liquid product) + (hydrogen in feed − hydrogen in total liquid product)]
[3]Insolubles = weight percent insolubles (in $C_6H_{12}$) in total recovered products

What is claimed is:

1. A method of catalytically hydroconverting a charge hydrocarbon feed stream containing a substantial quantity of components boiling above about 1000° F. to convert a substantial portion thereof to components boiling below 1000° F. which comprises:

(a) adding an aromatic heavy oil additive to a hydrocarbon feed stream containing a substantial quantity of components boiling above about 1000° F.;

(b) adding, as an oil-soluble catalyst, a compound of a metal of Group IV-B, V-B, VI-B, VII-B, or VIII to said hydrocarbon feed stream, thereby providing a hydrocarbon, aromatic heavy oil and soluble catalyst mixed stream;

(c) passing said hydrocarbon, aromatic heavy oil and soluble catalyst mixed stream into contact with a solid heterogeneous catalyst containing a metal of Group IV-B, V-B, VI-B, VII-B, or VIII on a support;

(d) maintaining said hydrocarbon, heavy oil and soluble catalyst mixed stream in contact with said solid heterogenous catalyst at conversion conditions and in the presence of hydrogen and mercaptan as a substantial portion of said components boiling above about 1000° F. are converted to components boiling below 1000° F. thereby forming a product containing a substantial portion of components boiling below about 1000° F.; and (e) recovering said product containing a substantial portion of components boiling below about 1000° F. and, optionally, recycling the portion of said product that still contains components boiling above about 1000° F. back into the hydrocarbon feed stream to enhance said conversion.

2. The method of claim 1 wherein the hydroconversions of said charge hydrocarbon feed stream takes place in a liquid phase and at a temperature of about 700° F. to about 850° F. and at a hydrogen partial pressure of about 500 to about 5000 psig.

3. The method of claim 2 wherein said temperature is from about 750° F. to about 810° F. and said hydrogen partial pressure is about 1500 to about 2500 psig.

4. The method of claim 1 wherein said highly aromatic heavy oil additive is heavy cycle gas oil.

5. The method of claim 1 wherein said oil-soluble catalyst is a molybdenum compound.

6. The method of claim 1 wherein said oil-soluble catalyst is a nickel compound.

7. The method of claim 1 wherein said oil-soluble catalyst comprises a compound of molybdenum and nickel.

8. The method of claim 7 wherein said oil-soluble catalyst comprises from about 0.2 to about 2 moles of nickel per mole of molybdenum.

9. The method of claim 1 wherein said oil-soluble catalyst is a cobalt compound.

10. The method of claim 1 wherein said oil-soluble catalyst comprises a compound of molybdenum and cobalt.

11. The method of claim 10 wherein said oil-soluble catalyst comprises from about 0.2 moles to about 2 moles of cobalt per mole of molybdenum.

12. The method of claim 1 wherein said oil-soluble catalyst is selected from the group consisting of molybdenum naphthenate, cobalt naphthenate, nickel 2-ethylhexanoate, molybdenum hexacarbonyl, molybdenum octoate and mixtures thereof.

13. The method of claim 1 wherein said oil-soluble catalyst is soluble in the hydrocarbon feed stream in amount of at least 0.001 grams per 100 grams of charge hydrocarbon.

14. The method of claim 1 comprising activating said oilsoluble catalyst is activated prior to passing said hydrocarbon, heavy oil and soluble catalyst mixed stream into contact with said solid heterogeneous catalyst.

15. The method of claim 1 comprising activating said oil-soluble catalyst an activation zone, by heating from about 400° F. to about 835° F. at about 500 to about 5000 psig partial pressure of hydrogen in the presence of mercaptan.

16. The method of claim 1 comprising activating said oil-soluble catalyst prior to hydroconversion by heating to 400° F.–835° F. at 500–5000 psig partial pressure of hydrogen in the presence of an oil which is miscible with said charge oil.

17. The method of claim 1 comprising activating said oil-soluble catalyst at conversion conditions.

18. The method of claim 1 comprising activating said oil-soluble catalyst during hydroconversion.

19. The method of claim 1 wherein said heterogeneous catalyst contains (i) as hydrogenating component, a metal of Groups IV-B, V-B, VI-B, VII-B, or VIII, and (ii) as a promoter, a metal of Group I-A, I-B, II-A, II-B, or V-A.

20. A method of catalytically hydroconverting a charge hydrocarbon feed stream containing a substantial quantity of components boiling above about 1000° F. to convert a substantial portion thereof to components boiling below 1000° F. which comprises:

(a) adding an aromatic heavy oil additive to a hydrocarbon feed stream containing a substantial quantity of components boiling above about 1000° F.;

(b) adding, as an oil-soluble catalyst, a compound selected from the group consisting of molybdenum naphthenate, cobalt naphthenate, nickel 2-ethylhexanoate, molybdenum hexacarbonyl, molybdenum octoate and mixtures thereof to said hydrocarbon feed stream, thereby providing a hydrocarbon, aromatic heavy oil and soluble catalyst mixed stream;

(c) passing said hydrocarbon, aromatic heavy oil and soluble catalyst mixed stream into contact with a solid heterogeneous catalyst containing a metal of Group IV-B, V-B, VI-B, VII-B, or VIII on a support;

(d) maintaining said hydrocarbon, aromatic heavy oil and soluble catalyst mixed stream in contact with said solid heterogeneous catalyst at conversion conditions and in the presence of hydrogen and mercaptan as a substantial portion of said components boiling above about 1000° F. are converted to components boiling below 1000° F. thereby forming a product containing a substantial portion of components boiling below about 1000° F.; and (e) recovering said product containing a substantial portion of components boiling below about 1000° F. and, optionally, recycling the portion of said product that still contains components boiling above about 1000° F. back into the hydrocarbon feed stream to enhance said conversion.

* * * * *